US006149500A

United States Patent [19]

Takahashi et al.

[11] Patent Number: 6,149,500

[45] Date of Patent: Nov. 21, 2000

[54] PRECISION POLISHING METHOD USING HERMETICALLY SEALED CHAMBERS

[75] Inventors: Kazuo Takahashi, Kawasaki; Mikichi Ban, Miura; Matsuomi Nishimura, Omiya, all of Japan

[73] Assignee: Canon Kabushiki Kaisha, Tokyo, Japan

[21] Appl. No.: 09/304,629

[22] Filed: May 4, 1999

Related U.S. Application Data

[62] Division of application No. 08/840,627, Apr. 25, 1997, Pat. No. 5,904,611.

[30] Foreign Application Priority Data

May 10, 1996 [JP] Japan ..... 8-141077
Jul. 3, 1996 [JP] Japan ..... 8-192815

[51] Int. Cl.[7] ..... B24B 1/00; B24B 55/00

[52] U.S. Cl. ..... 451/41; 451/67; 451/451

[58] Field of Search ..... 438/692, 693; 451/41, 67, 89, 451, 456

[56] References Cited

U.S. PATENT DOCUMENTS

| | | | |
|---|---|---|---|
| 3,693,953 | 9/1972 | Michel . | |
| 3,834,293 | 9/1974 | Danieli . | |
| 4,584,045 | 4/1986 | Richards . | |
| 4,624,690 | 11/1986 | Byrnes . | |
| 4,956,944 | 9/1990 | Ando et al. . | |
| 4,967,645 | 11/1990 | Mattson . | |
| 5,399,233 | 3/1995 | Murazumi et al. . | |
| 5,417,608 | 5/1995 | Elliott | 451/81 |
| 5,651,723 | 7/1997 | Bjornard et al. | 451/89 X |
| 5,653,623 | 8/1997 | Kimura et al. | 451/72 |
| 5,655,954 | 8/1997 | Oishi et al. | 451/288 X |
| 5,679,059 | 10/1997 | Nishi et al. | 451/286 X |

FOREIGN PATENT DOCUMENTS

| | | |
|---|---|---|
| 0635873 A1 | 1/1995 | European Pat. Off. . |
| 0648575 A1 | 4/1995 | European Pat. Off. . |
| 195 44 328 | 5/1996 | Germany . |
| 6252110 | 9/1994 | Japan . |

OTHER PUBLICATIONS

Patent Abstracts of Japan, vol. 095, No. 011, Dec. 26, 1995 & JP 07 230974 A (Fujitsu Ltd; Others: 01), Aug. 29, 1995.

Patent Abstracts of Japan, vol. 018, No. 507 (E–1609), Sep. 22, 1994 & JP 06 177060 A (Kokusai Electric Co Ltd), Jun. 24, 1994.

*Primary Examiner*—Timothy V. Eley
*Attorney, Agent, or Firm*—Fitzpatrick, Cella, Harper & Scinto

[57] ABSTRACT

A precision polishing apparatus has a first hermetically sealed chamber provided with polishing means, a third hermetically sealed chamber capable of communicating with the first hermetically sealed chamber through a second hermetically sealed chamber, first and second opening-closing means for alternately placing the first and the third hermetically sealed chamber in communication with the second hermetically sealed chamber, and atmosphere pressure control means for controlling the atmosphere pressure of the first and the second hermetically sealed chamber so that the atmosphere pressure of the first hermetically sealed chamber may become lower than the atmosphere pressure of the second hermetically sealed chamber when at least the first opening-closing means is opened.

4 Claims, 14 Drawing Sheets

PRECISION POLISHING METHOD USING HERMETICALLY SEALED CHAMBERS

This application is a division of application Ser. No. 08/840,627, filed Apr. 25, 1997, now U.S. Pat. No. 5,904, 611.

BACKGROUND OF THE INVENTION

1. Field of the Invention

This invention relates to a precision polishing apparatus for highly accurately polishing the surface or the like of a substrate such as a wafer on which dielectric material layers are laminated in a semiconductor device manufacturing process.

2. Related Background Art

In recent years, the tendency of semiconductor devices toward a high degree of minuteness has advanced and the accuracy of the order of submicrons has been required of the line width of minute patterns. Along with this, the technique of highly accurately flattening the surface of a substrate such as a wafer on which wiring or dielectric material layers are laminated has become necessary and a precision polishing apparatus adopting so-called mechano-chemical polishing or the like techniques in which a chemical reaction is effected on a polished surface has been developed.

Referring to FIG. 17 of the accompanying drawings which shows a precision polishing apparatus the inventor designed prior to the present invention, this apparatus has a substrate holder 1002 for adsorbing and holding a pair of wafers $W_0$ in such a manner that the polished surfaces thereof face downward and conveying then along a guide 1001, loading portions 1003 disposed in series in the direction of conveyance of the wafers, a wafer centering portion 1004, a polishing portion 1005 for rotating a polishing pad 1005*a* on a stool, a wafer washing portion 1006, a wafer reversing portion 1007 and an unloading portion 1008.

Wafers $W_0$ contained in a loading cassette $G_1$ and carried in from the pre-process are taken out of the loading cassette $G_1$ in the loading portion 1003, and are subjected to centering in the wafer centering portion 1004, whereafter they are adsorbed by the substrate holder 1002 and conveyed to the polishing portion 1005. In the polishing portion 1005, the substrate holder 1002 is made to cross along the diameter of the polishing pad 1005*a* while each wafer $W_0$ is lightly urged against the surface of the polishing pad 1005*a* being rotated, thereby polishing the underside (the polished surface) of each wafer $W_0$. The substrate holder 1002 which, as crossed the polishing pad 1005*a* is continuedly moved along the guide 1001 and arrives at the wafer washing portion 1006. Here, washing liquid is blown from a nozzle 1006*a* on to the polished surface of each wafer $W_0$ to thereby remove the secondary product of polishing. The wafer reversing portion 1007 reverses the washed wafer $W_0$ and transports it to the unloading portion 1008. In the unloading portion 1008, the water $W_0$ is contained in an unloading cassette $G_2$ and sent out to the next step.

The substrate holder 1002 is suspended from a top frame 1002*a* movable above the wafer centering portion 1004, the polishing portion 1005, the wafer washing portion 1006, etc., and one end of the top from 1002*a* is supported from reciprocal movement along the guide 1001 and the other end thereof is connected to a driving portion 1002*b*. The top frame 1002*a*suspended from the substrate holder 1002 is reciprocally moved along the guide 1001 by the driving of the driving portion 1002*b*. The polishing portion 1005 is provided with a brushing device 1005*b* and a hand shower

1005*c* for cleaning the surface of the polishing pad 1005*a*. As described above, the apparatus is designed such that the polishing of the wafers $W_0$ continuously fed in from the pre-process and the subsequent washing step are automatically executed and the wafers are fed to the next step and the work of cleaning the surface of the polishing pad 1005*a* can be done efficiently which the substrate holder 1002 is moved in the opposite direction and returned from the unloading portion 1008 to the loading portion 1003.

According to the above-described technique, however, the series of steps of taking out the wafer carried in by a conveying device such as a conveyor out of the cassette, polishing the wafer and washing the polished surface thereof are automated to thereby greatly contribute to a reduction in the manufacturing cost of semiconductor devices or the like, but dust such as polishing powder created in the polishing portion enters the loading portion and the wafer washing portion adjoining the polishing portion and deteriorates the performance of the driving portion for these, and this leads to the problem of high cost which is left to be solved.

Also, an exposure apparatus or the like for wafer in the pre-process is generally operated under a cleaned atmosphere such as a clean room or the like and therefore, if the dust created in the polishing portion contaminates the atmosphere of the clean room, the performance of the exposure apparatus or the like may be remarkably spoiled. Further, is a great deal of polishing powder or the like enters the wafer washing portion together with the wafer taken out of the polishing portion, the quantity of washing liquid consumed will increase and the time spent for the washing of the wafer will also lengthen with a result that the manufacturing cost of semiconductor devices or the like will rise.

SUMMARY OF THE INVENTION

The present invention has as its object to provide a precision polishing apparatus in which dust such as polishing powder may not contaminate devices for effecting a pre-process and a post-process such as the centering and washing of a wafer and the atmosphere of a clean room in which these devices are disposed and moreover, the mechanism and control are simple and which is suitable for speedup and automation.

The present invention provides a precision polishing apparatus provide a precision polishing apparatus having a first hermetically sealed chamber provided with polishing means, a third hermetically sealed chamber capable of communicating with the first hermetically sealed chamber through a second hermetically sealed chamber, first and second opening-closing means for alternately placing the first and the third hermetically sealed chamber in communications with the second hermetically sealed chamber, and atmosphere pressure control means for controlling the atmosphere pressure of the first and the second hermetically sealed chamber so that the atmosphere pressure of the first hermetically sealed chamber may become lower than the atmosphere pressure of the second hermetically sealed chamber when at least the frist opening-closing means is opened.

The present invention provides a precision polishing method of polishing an object to be polished by precision polishing apparatus having a first hermetically sealed chamber provided with polishing means, a third hermetically sealed chamber capable of communicating with the first hermetically sealed chamber through a second hermetically sealed chamber, first and second opening-closing means for alternately communicating the first and the third hermetically sealed chamber with the second hermetically sealed chamber, and atmosphere pressure control means for controlling the atmosphere pressure of the first and the second hermetically sealed chamber so that the atmosphere pressure of the first hermetically sealed chamber may become lower than the atmosphere pressure of the second hermetically sealed chamber when at least the first opening-closing means is opened.

Also, the present invention provides a precision polishing apparatus having a first hermetically sealed chamber provided with polishing means, a second hermetically sealed chamber, opening-closing means for placing the first and the second hermetically sealed chamber in communication with each other, and atmosphere pressure control means for controlling the atmosphere pressure of the first and the second hermetically sealed chamber so that the atmosphere pressure of the first hermetically sealed chamber may become lower than the atmosphere pressure of the second hermetically sealed chamber when the opening-closing means is opened, characterized in that the first hermetically sealed chamber has a downflow mechanism for blowing clean air downwardly from above.

Also, the present invention provides a precision polishing apparatus having a first unit for making an object to be polished wait temporarily, a second unit provided with polishing means for polishing the object to be polished transported from the first unit, a third unit for washing the object to be polished transported from the second unit, a fourth unit for drying the object to be polished transported from the third unit, hermetically sealing means for individually hermetically sealing the atmospheres of the first to fourth units, and atmosphere pressure control means for controlling the atmosphere pressure of each of the units to a value lower than the outside atmosphere pressure.

Also, the present invention provides a precision polishing apparatus having a first hermetically sealed chamber provided with polishing means for polishing an object to be polished, second and third hermetically sealed chambers adjoining the carry-in side and carry-out side, respectively, of the first hermetically sealed chamber, a fluid partition wall device for communicating respective ones of the second and third hermetically sealed chambers switch the first hermetically sealed chamber through a fluid contain capable of being transmitted through the object to be polished, and atmosphere pressure control means for controlling the atmosphere pressure of each of the first, second and third hermetically sealed chambers so that the atmosphere pressure of the first hermetically sealed chamber may become lower than the atmosphere pressure of each of the second and third hermetically sealed chambers.

Also, the present invention provides a precision polishing apparatus having a first unit for making an object to be polished wait temporarily, a second unit provided with polishing means for polishing the object to be polished transported from the first unit, a third unit for washing the object to be polished transported from the second unit, a fourth unit for drying the object to be polished transported from the third unit, hermetically sealing means for individually hermetically sealing the atmospheres of the first to fourth units, and atmosphere pressure control means for controlling the atmosphere pressure of each of the units to a value lower than the outside atmosphere pressure, characterized in that the hermetically sealing means is provided with a fluid partition wall device for communicating at least the first unit and the second unit with each other through a fluid curtain capable of being transmitted through the object to be polished or a liquid tank.

The present invention achieves the following effects.

A precision polishing apparatus in which an object to be polished such as a wafer is carried into a hermetically sealed chamber provided with polishing means from a preceding hermetically sealed chamber, and then the object to be polished is conveyed into a succeeding hermetically sealed chamber controls the atmosphere pressure of each hermetically sealed chamber so that the atmosphere pressure of the hermetically sealed chamber provided with the polishing means may become lower than the pressure of the other hermetically sealed chambers, thereby preventing dust from entering the hermetically sealed chamber preceding or succeeding the hermetically sealed chamber provided with the polishing means.

Also, a hermetically sealed chamber is provided between the units and opening-closing means are designed to be alternately opened, thereby preventing dust from entering from the hermetically sealed chamber provided with the polishing means into the preceding or succeeding unit.

If each opening-closing means is provided with partial opening means for partially opening it and the atmosphere pressure control means is provided with exhaust means for normally exhausting the air from the first hermetically sealed chamber, the clean air or the like around the precision polishing apparatus can be sucked into the first hermetically sealed chamber via the third hermetically sealed chamber and the second hermetically sealed chamber to thereby create a stream of clean air normally flowing toward the first hermetically sealed chamber. Thereby the clean atmosphere in a clean room or the like wherein an exposure apparatus or the like is disposed with the precision polishing apparatus and the second and third hermetically sealed chambers can be reliably prevented from being contaminated by the polishing powder or the like.

It can be avoided that the dust such as the polishing powder to contaminates the device for effecting the pre-process such as the centering and washing of wafers and the atmosphere in the clean room outside it, and moreover, the mechanism and control are simple and the automation and speedup of the polishing process can be greatly expedited. Thereby, the running cost and maintenance cost of the precision polishing apparatus can be reduced and also, troubles such as a reduction in the performance of the exposure apparatus or the like in the clean room caused by the polishing powder or the like and the rise of the maintenance cost can be avoided and the throughput of the precision polishing apparatus can be improved to thereby greatly contribute to the lower prices of semiconductor devices or the like.

It can be avoided that the dust such as the polishing powder contaminates the device for effecting the pre-process such as the centering and washing of wafers and the atmosphere in the clean room outside it. Thereby, the running cost and maintenance cost of the precision polishing apparatus can be reduced and also, troubles such as a reduction in the performance of the exposure apparatus or the like in the clean room caused by the polishing powder or the like and the rise of the maintenance cost can be avoided to thereby greatly contribute to the lower prices of semiconductor devices or the like.

DESCRIPTION OF THE PREFERRED EMBODIMENTS

First Embodiment

Figure 1:
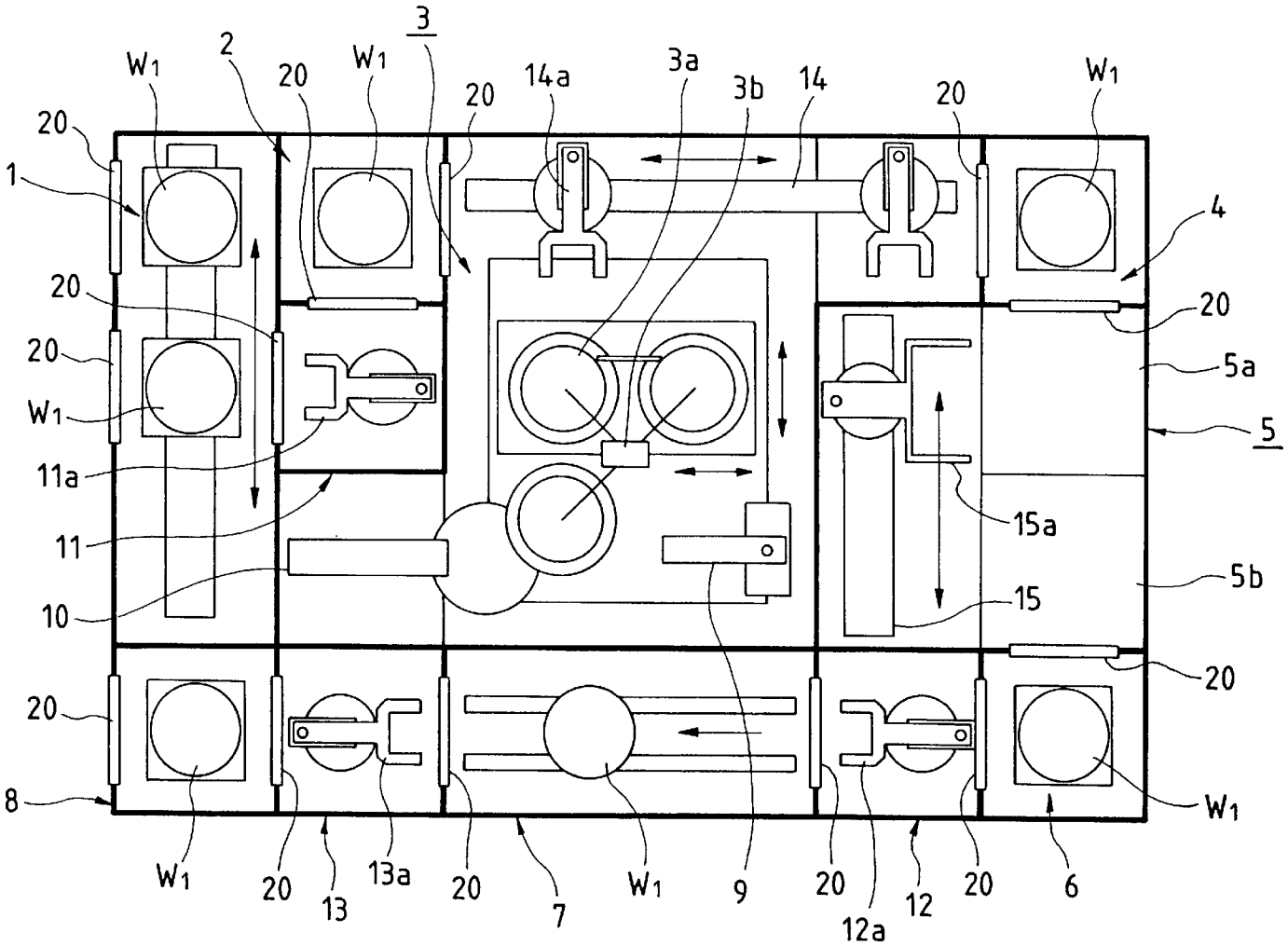
FIG. 1 is a model view illustrating a precision polishing apparatus according to a first embodiment of the present invention.

Referring to FIG. 1 which shows a precision polishing apparatus according to a first embodiment of the present invention, this apparatus has a loading unit 1 for receiving at least one wafer $W_1$ which is an object to be polished bodily with a cassette from a conveyor, not shown, a wafer stocker unit 2 which is a first unit for effecting the centering of the wafer $W_1$ taken out of the loading unit 1 and making it temporarily wait, and a polishing unit 3 which is a second unit for holding the wafer $W_1$ in such a manner that the polished surface thereof faces upward, and polishing the polished surface of the wafer $W_1$ by downwardly facing polishing pads 3*a* which is polishing means while slurry is supplied from a slurry supply device 3*b*. A pre-washing unit 4 is for blowing washing liquid against the wafer $W_1$ after it has been polished to and effect the preliminary washing of the wafer, a washing unit 5 is a third unit for washing the wafer $W_1$ by first and second washing tanks 5*a* and 5*b* in succession, and a spin dehydration unit 6 for rotating the wafer $W_1$, thereby to remove the washing liquid adhering thereto. A drying unit 7 is a fourth unit for blowing cold wind or the like against the wafer $W_1$ thereby to completely dry it, and an unloading unit 8 is for sending out the dried wafer $W_1$ to the next step, the units 1 to 8 together constitute a hermetically sealed chamber having its interior atmosphere hermetically sealed by hermetically sealing means. The loading unit 1 and the unloading unit 8 are of a construction in which they are disposed on one side of the precision polishing apparatus and an opening-closing door 20 is disposed on the same side. Thereby, it becomes possible to save the space for bringing the object to be polished into and out of the precision polishing apparatus. This is a construction important for the saving of an operator's working space.

The polishing unit 3 is provided with a plurality of downwardly facing polishing pads 3*a* as previously described, and these polishing pads are alternately reproduced by a hand dresser 9, and when the reproduction is impossible, they are interchanged with new polishing pads by means of a polishing pad interchanging unit 10. The polishing unit 3 has a downflow mechanism, not shown, which supplies air from the ceiling and exhausts the air below. The downflow mechanism is for supplying the interior of the polishing unit 3 with a highly clean inert gas such as highly clean air or highly clean nitrogen gas used in a clean room to prevent polishing scraps produced during polishing, slurry particles, organic solvent, etc., from being diffused outside the polishing unit 3. The downflow as it is called is a flow of gas from above to below, and if there is created such a downflow of gas, the gas supply port may be provided not in the ceiling wall, but in the side wall .

A first transporting robot chamber 11 is provided between the loading unit 1 and the wafer stocker unit 2, and a rotatable type first transporting robot 11*a* is disposed therein. Likewise, a second transporting robot chamber 12 is provided between the spin dehydration unit 6 and the drying unit 7, and a rotatable type second transporting robot 12*a* is disposed therein. A third transporting robot chamber 13 is provided between the drying unit 7 and the unloading unit 8, an d a rotatable type third transporting robot 13*a* is disposed therein.

The first to third transporting robot chambers 11 to 13 are hermetically sealed chambers having their interior atmosphere hermetically sealed.

The polishing unit 3 has a fourth transporting robot 14*a* reciprocally movable along a guide 14, and the washing unit 5 ha s a washing robot 15*a* for conveying the wafer $W_1$ to first and second washing tanks 5*a* and 5*b* in success ion along a guide 15.

All of the units 1 to 8 and the hermetically sealed chambers such as the transporting robot chambers 11 to 13 are isolated from the atmosphere around the precision polishing apparatus by a partition wall and an opening-closing door, which is slide type opening-closing means and is disposed between the hermetically sealed chambers adjoining each other, and when each opening-closing door 20 is opened, the atmosphere pressure of the hermetically sealed chambers is controlled as follows by atmosphere pressure control means, not shown.

Figure 2A:
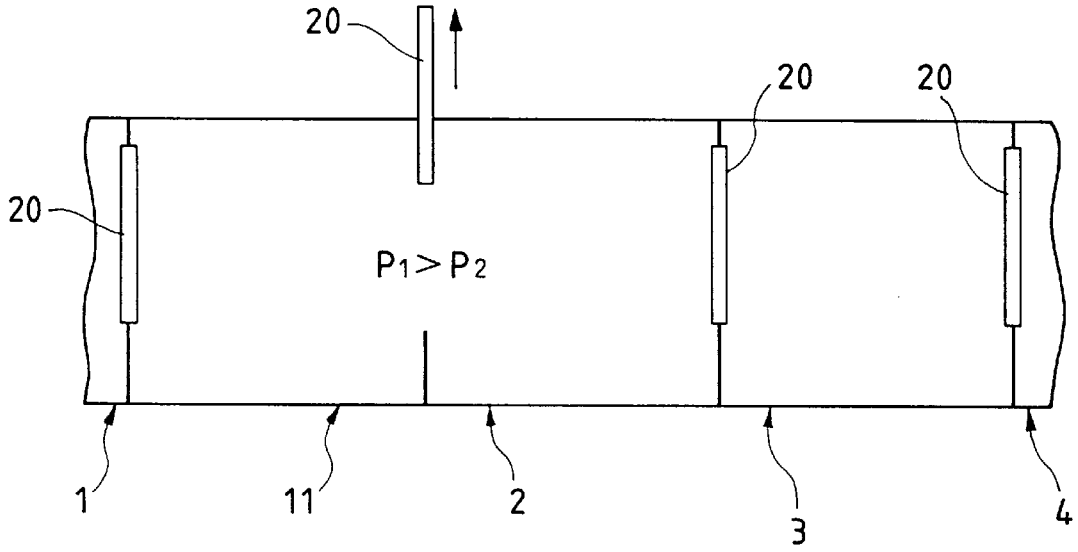
FIGS. 2A and 2B show portions of the apparatus of FIG. 1, FIG. 2A being an illustration showing a state in which the opening-closing door between a first transporting robot chamber and a wafer stocker unit is opened, and FIG. 2B being an illustration showing a state in which the opening-closing door between the wafer stocker unit and a polishing unit is opened.
Figure 2B:
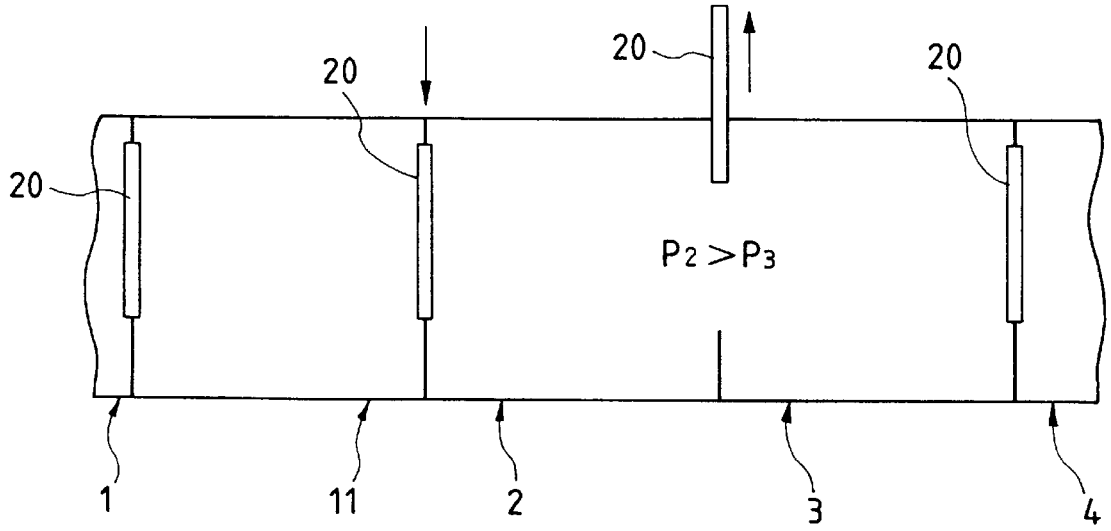

When a wafer, not shown, carried from the loading unit 1 to into the first transporting robot chamber 11 is to be conveyed to the polishing unit 3 via the wafer stocker unit 2, the atmosphere pressure $P_2$ in the wafer stocker unit 2 is first rendered lower than the atmosphere pressure $P_1$ in the first transporting robot chamber 11 and the opening-closing door 20 therebetween is opened as shown in FIG. 2A, and the wafer is carried into the wafer stocker unit 2 by the transporting robot 11*a* and the opening-closing door 20 adjacent to the transporting robot chamber 11 is closed. Subsequently, as shown in FIG. 2B, the atmosphere pressure $P_2$ in the wafer stocker unit 2 is rendered higher than the atmosphere pressure $P_3$ in the polishing unit 3 and the opening-closing door 20 therebetween is opened to thereby carry the wafer into the polishing unit 3 and polish it.

Also, when the wafer is to be carried from the polishing unit 3 into the pre-washing unit 4, the atmosphere pressure in the polishing unit 3 is rendered lower than the atmosphere pressure in the pre-washing unit, and the opening-closing door 20 is opened thereby to effect the delivery of the wafer by the fourth transporting robot 14*a*.

If as described above, the atmosphere pressure in the hermetically sealed chamber farther from the polishing unit 3 is controlled so as to be higher when the opening-closing door 20 of the hermetically sealed chambers adjoining each other is opened, dust such as polishing powder or the like created in the polishing unit 3 can be prevented from entering the wafer stocker unit 2 and the transporting robot chamber 11 or the washing unit 5 or the like in any great amount. As a result, the running cost and maintenance cost of the precision polishing apparatus can be greatly reduced. Also, when the precision polishing apparatus is disposed in a clean room together with an exposure apparatus or the like, the atmosphere in the clean room can be prevented from being contaminated by the polishing powder or the like, and this contributes to the improved performance and reduced maintenance cost of the exposure apparatus or the like.

As regards also the remaining opening-closing door 20 disposed downstream of the polishing unit 3, as described above, the atmosphere pressure in the hermetically sealed chamber farther from the polishing unit 3 is controlled so as to be higher and thereafter, the opening-closing door 20 is opened to effect the delivery of the wafer.

Figure 3A:
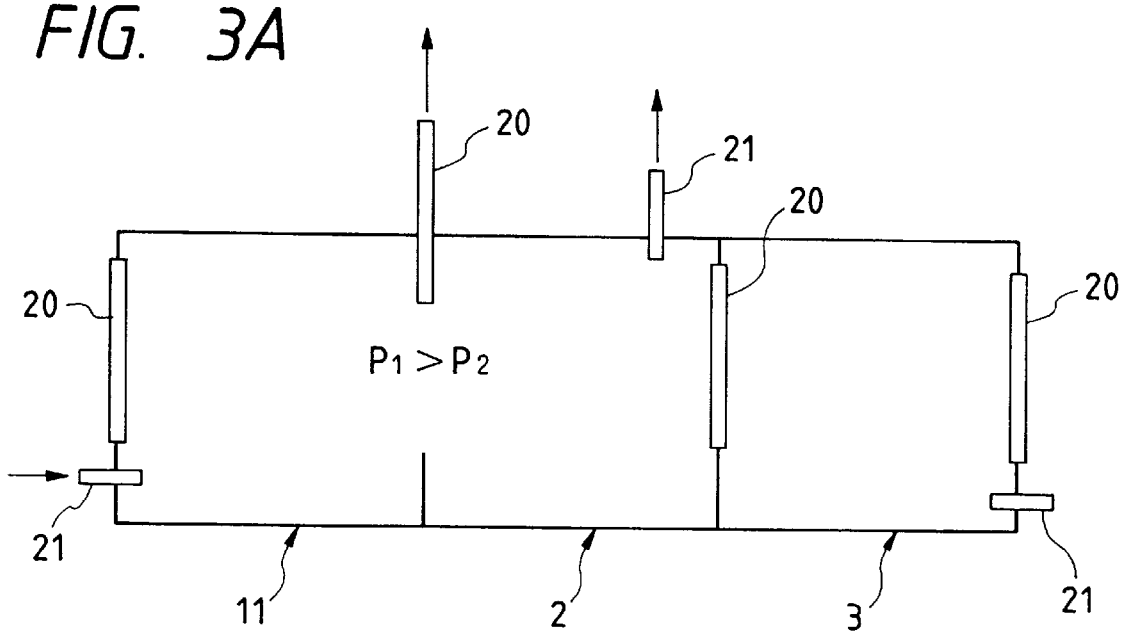
FIGS. 3A and 3B illustrate methods of pressurizing or reducing the pressure of each hermetically sealed chamber of the apparatus of FIGS. 2A and 2B.
Figure 3B:
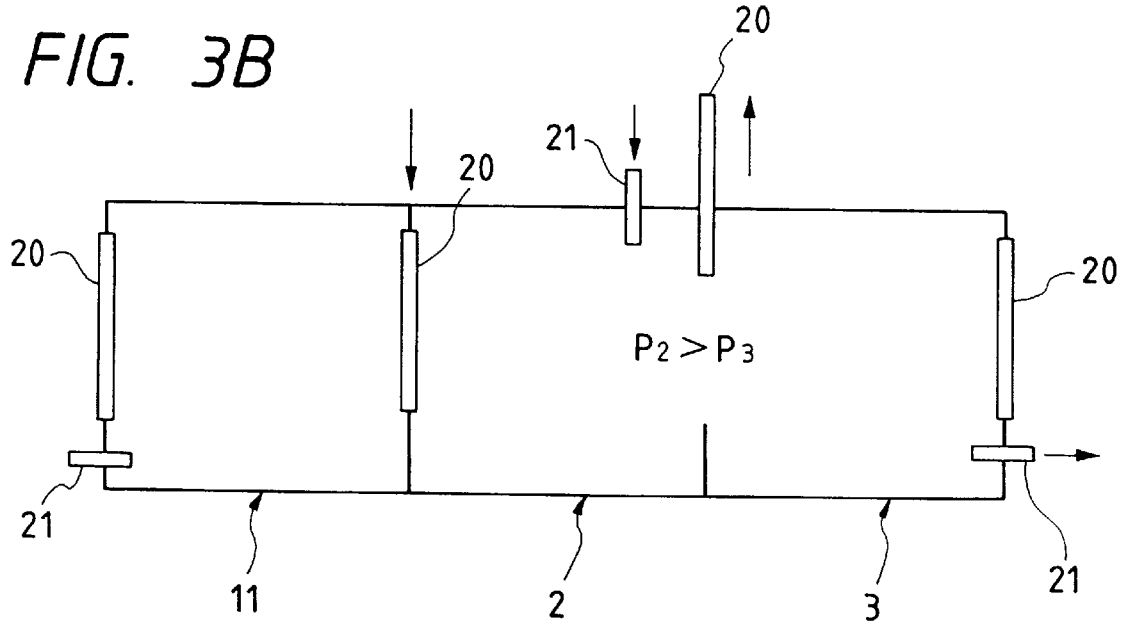

To control the atmosphere pressure in each hermetically sealed chamber, an air supply and exhaust port 21 which is air supply and exhaust means can be provided in each hermetically sealed chamber, as shown in FIGS. 3A and 3B, and when the opening-closing door 20 is to be opened, clean air can be supplied from the air supply and exhaust port 21 of one hermetically sealed chamber and air can be exhausted from the air supply and exhaust port 21 of the other hermetically sealed chamber to thereby provide a pressure difference between the atmospheres in the two hermetically sealed chambers, but air can also be supplied to or exhausted from only one hermetically sealed chamber to thereby provide a pressure difference between the atmospheres in the two hermetically sealed chambers.

Also, if a slit opening or the like which is partial opening means is provided in each opening-closing door 20 and air is continuously exhausted from the polishing unit 3 by exhaust means, not shown, the clean air around the precision polishing apparatus is sequentially sucked into each hermetically sealed chamber and there is created an air flow including the clean air, and the atmosphere pressure in each unit becomes lower than the atmosphere pressure around the precision polishing apparatus (the outside atmosphere pressure), and further, there is created a pressure gradient in which the atmosphere pressure is lower in the hermetically sealed chambers nearer to the polishing unit 3. If a state in which the atmosphere pressure is thus higher in the hermetically sealed chambers farther from the polishing unit 3 is normally maintained, it is unnecessary to control the atmosphere pressure in each hermetically sealed chamber each time the opening and closing of the opening-closing door 20 are effected.

Second Embodiment

A second embodiment is an embodiment in which the opening-closing doors 20 in the first embodiment are replaced by cylindrical doors having transporting robots.

Figure 4A:
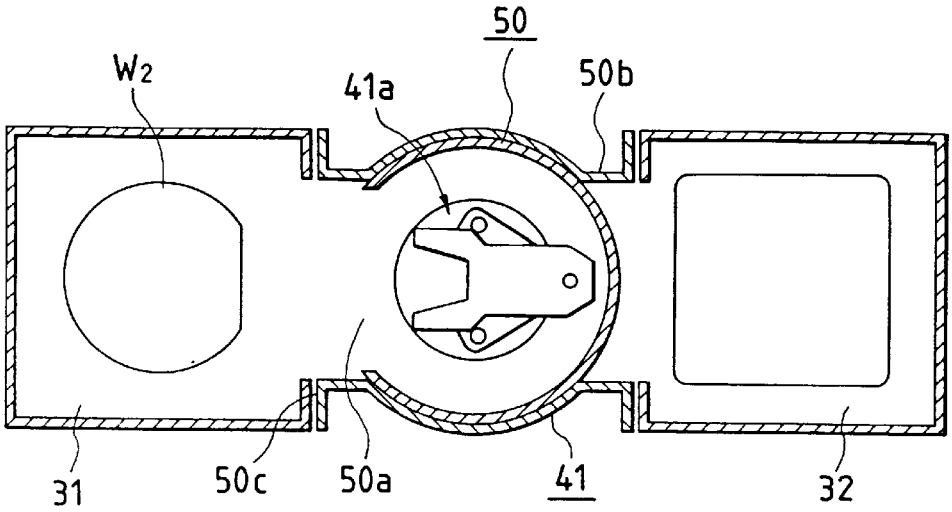
FIGS. 4A, 4B and 4C show loading units, a transporting robot chamber and a wafer stocker unit according to a second embodiment of the present invention, FIG. 4A being a cross-sectional view illustrating a state in which a cylindrical door is opened to a loading unit, FIG. 4B being a cross-sectional view illustrating a state in which the cylindrical door is being rotated from the state shown in FIG. 4A to the wafer stocker unit side, and FIG. 4C being a cross-sectional view illustrating a state in which the cylindrical door has been opened to the wafer stocker unit side.
Figure 4B:
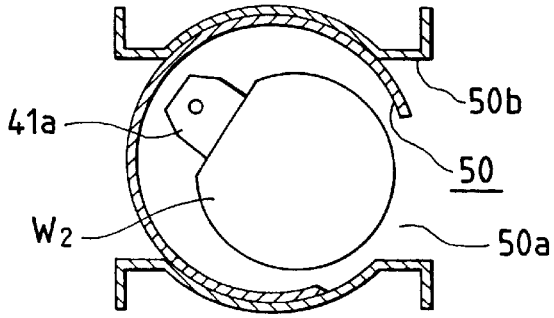
Figure 4C:
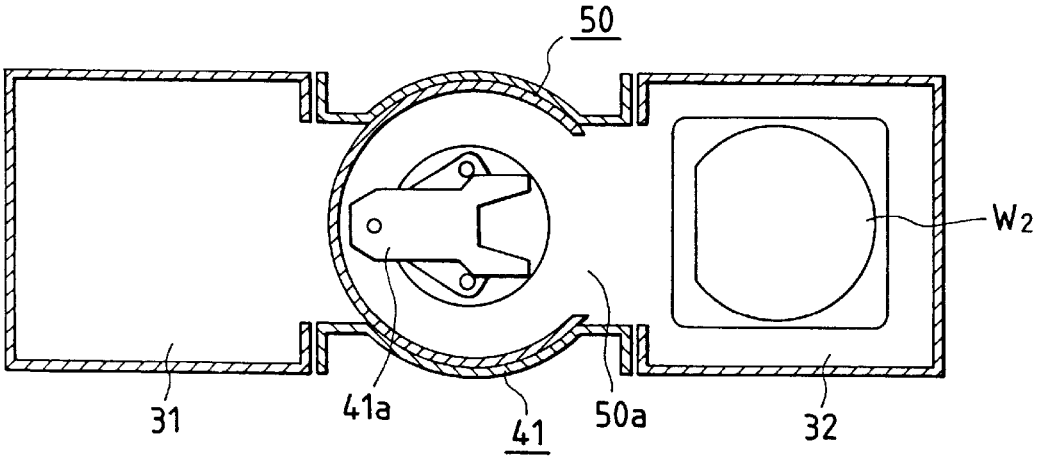

Referring to FIGS. 4A to 4C which are model views showing only the loading unit 31, the wafer stocker unit 32 and the first transporting robot chamber 41 of the precision polishing apparatus, the first transporting robot chamber 41 has a rotatable type transporting robot 41*a*, and instead of the opening-closing door 20, a cylindrical door 50 rotatable in operative association with the rotation of the transporting robot 41*a* is provided between the loading unit 31 and the wafer stocker unit 32. The cylindrical door 50 is provided with an opening 50*a* in a portion of the cylindrical partition wall thereof, and is rotatably contained in a casing 50*b*, and the opposite ends of the casing 50*b* are fixed to the loading unit 31 and the wafer stocker unit 32 through hermetically sealing members 50*c*, whereby the transporting robot chamber 41 is formed.

When a wafer $W_2$ is to be transported, the space between the wafer stocker unit 32 and the transporting robot chamber 41 is first closed by the cylindrical door 50 as shown in FIG. 4A and it is confirmed that the atmosphere pressure in the loading unit 31 and the transporting robot chamber 41 is higher than the atmosphere pressure in the wafer stocker unit 32 and thereafter, as shown in FIG. 4B, the cylindrical door 50 is rotated with the transporting robot 41*a*, and as shown in FIG. 4C, is stopped at a position in which the opening 50*a* in the cylindrical 50 door faces the wafer stocker unit 32. Subsequently, the transporting unit 41*a* is protruded into the wafer stocker unit 32 to thereby effect the delivery of the wafer $W_2$.

If the rotatable type cylindrical door thus operatively associated with the rotation of the transporting robot is provided in each transporting robot chamber, the drive portion will be simple as compared with a case where a slide type opening-closing door is used to drive it individually from the transporting robot, and it will be unnecessary to control the timing of opening and closing in accord with the driving of the transporting robot. While this cylindrical door is provided between the loading unit 1 and the wafer stocker unit 2 which are shown in FIG. 1, it may be provided between the units as required.

Figure 5:
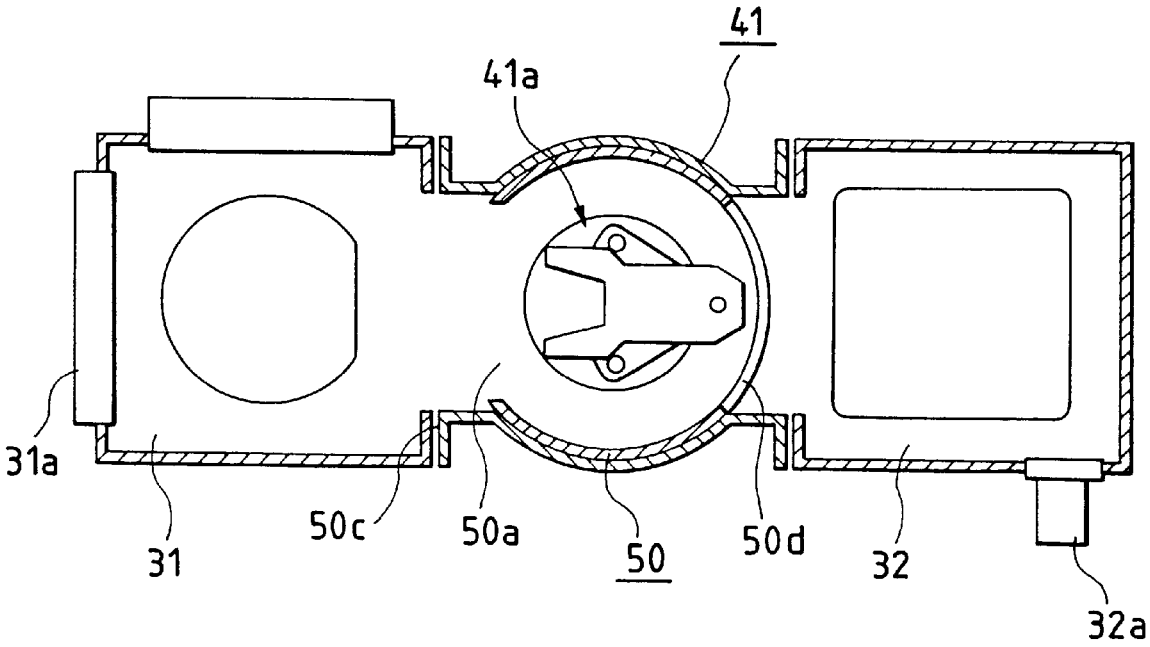
FIG. 5 illustrates a case where slits are provided in the cylindrical door.

To create the pressure gradient as described above in the atmosphere pressure in the loading unit 31 and the wafer stocker unit 32, there may be adopted a method of providing an air supply and exhaust port and pressurizing means in each hermetically sealed chamber, as in FIGS. 3A and 3B, or a clean filter 31*a* may be provided at the entrance of the loading unit 31, as shown in FIG. 5, and the pressure in the wafer stocker unit 32 may be reduced by air exhaust means connected to an exhaust port 32*a*, thereby to clean and introduce the desired atmosphere around the precision polishing apparatus. In this case, slits 50*d* are provided in the cylindrical door 50 and the loading unit 31 and the wafer stocker unit 32 are designed to communicate with each other through the slits 50*d* even when the cylindrical door 50 opens only to the loading unit 31 side or opens only to the wafer stocker unit 32 side. Thereby an air flow is always created from the loading unit 31 toward the wafer stocker unit 32 and the above-mentioned pressure gradient is formed between the two.

Figure 6:
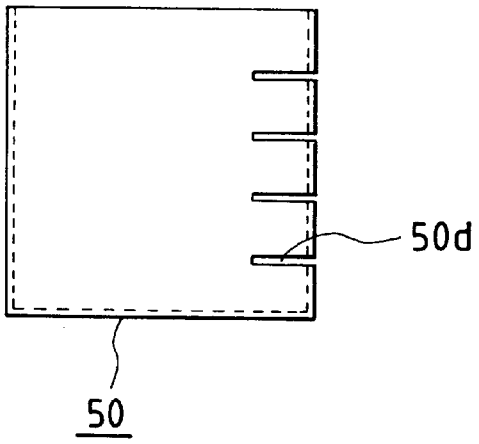
FIG. 6 is a side view showing the arrangement of the slits in the cylindrical door of FIG. 5.
Figure 7:
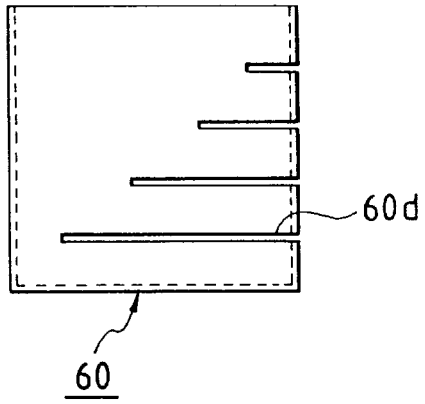
FIG. 7 is a side view showing a cylindrical door according to a modification in which the arrangement of the slits of FIG. 6 is changed.

The slits 50*d* in the cylindrical door 50 may be a plurality of slits extending the same length in the circumferential direction of the cylindrical door 50, as shown in FIG. 6, or the cylindrical door may be a cylindrical door 60 as shown in FIG. 7 wherein the length of slits 60*d* is stepwisely varied.

The length and disposition of the slits 50*d*, 60*d* of the cylindrical door 50, 60 must be set so that in whatever rotated position the cylindrical door 50, 60 may be, the loading unit 31 and the wafer stocker unit 32 may communicate with each other through at least one of the slits. Generally it is desirable that the opening 50*a* in the cylindrical door 50 open in the form of a circular arc of 30 to 90 degrees about the center axis of the cylindrical door 50 and each slit 50*d* extend in the form of a circular arc of 180 degrees or greater. This also holds true of the cylindrical door 60.

Figure 8:
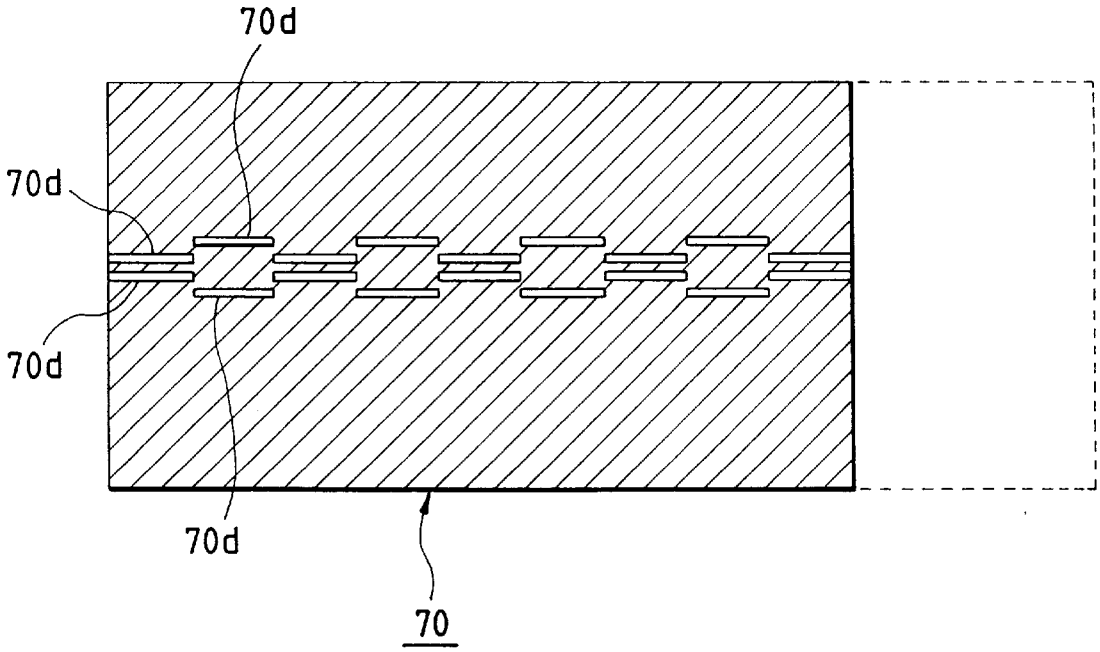
FIG. 8 is a developed view showing a cylindrical door according to a modification in which the arrangement of the slits of FIG. 6 is changed as it is developed into a planar state.

Also, use may be made of a cylindrical door 70 as shown in the developed view of FIG. 8 wherein at least one pair of relatively short slits 70*d* are disposed in the circumferential direction. In this case, respective pairs of slits 70*d* are provided so that the disposed positions thereof may be stagger for each pair, whereby the hermetically sealed chambers on the opposite sides may normally communicate with each other.

Third Embodiment

Figure 9:
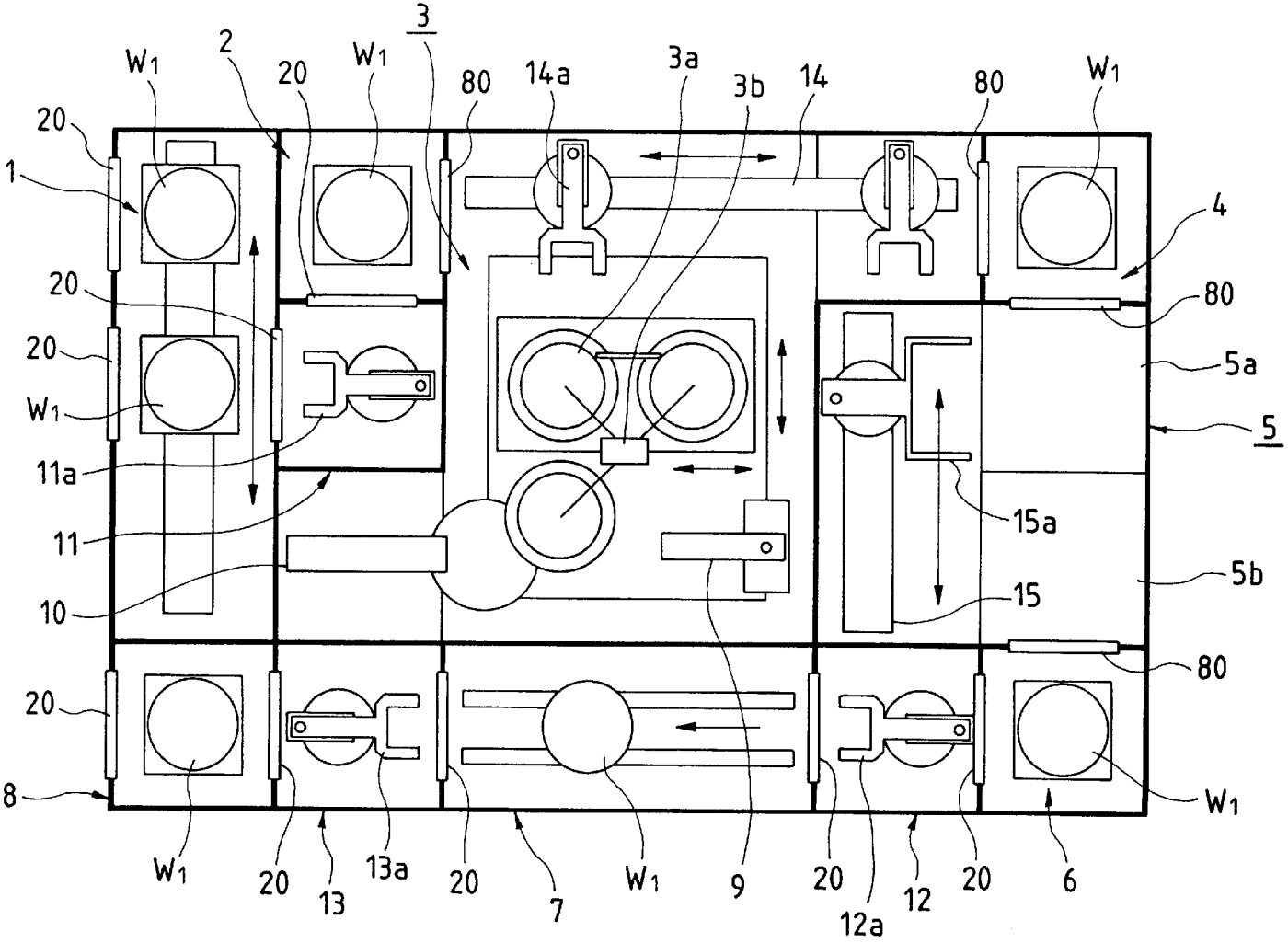
FIG. 9 is a model view illustrating a precision polishing apparatus using a fluid partition wall according to a third embodiment of the present invention as opening-closing means.

As shown in FIG. 9, a third embodiment is an embodiment in which a first fluid partition wall device 80 as opening-closing means for isolating each hermetically sealed chamber is disposed between the wafer stocker unit 2 and the polishing unit 3, a second fluid partition wall device 80 is disposed between the polishing unit 3 and the pre-washing unit 4, a third fluid partition wall device 80 is disposed between the pre-washing unit 4 and the washing unit 5, and a fourth fluid partition wall device 80 is disposed between the washing unit 5 and the spin dehydration unit 6. The portions among the remaining hermetically sealed chambers, i.e., the portion between the loading unit 1 and the first transporting robot chamber 11 and the portions among the hermetically sealed chambers from the spin dehydration unit 6 to the unloading unit 8 are partitioned by the afore-described slide type opening-closing doors 20. Likewise, opening-closing doors 20 are provided at the wafer inlet of the loading unit 1 and the wafer outlet of the unloading unit 8.

Figure 10A:
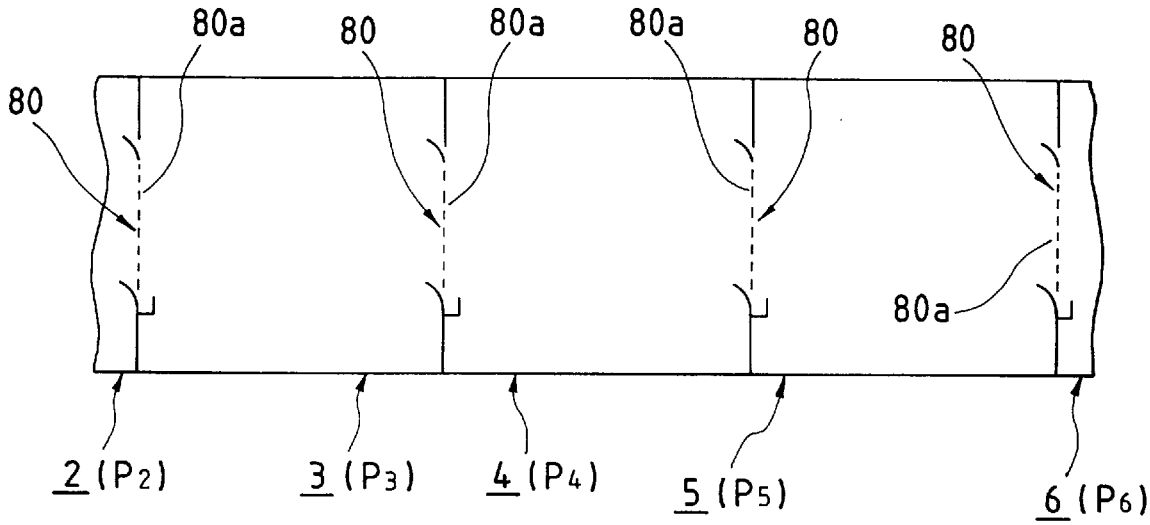
FIGS. 10A and 10B show portions of the apparatus of FIG. 9, FIG. 10A being a fragmentary model cross-sectional view showing a wafer stocker unit to a spin dehydration unit, and FIG. 10B being an enlarged fragmentary cross-sectional view showing the fluid partition wall device on an enlarged scale.

Each fluid partition wall device 80, as shown in FIG. 10A, shuts off the atmosphere in the hermetically sealed chambers adjoining one another (the units 2 to 6) by a water curtain 80*a* and keeps the air-tightness of each hermetically sealed chamber, and can effect the transportation of the wafer $W_1$ while maintaining the pressure gradients $P_2>P_3$, $P_3<P_4<P_5<P_6$ in the hermetically sealed chambers 2 to 6 when the pressures in the hermetically sealed chambers 2 to 6 are defined as $P_2$, $P_3$, $P_4$, $P_5$ and $P_6$.

Figure 10B:
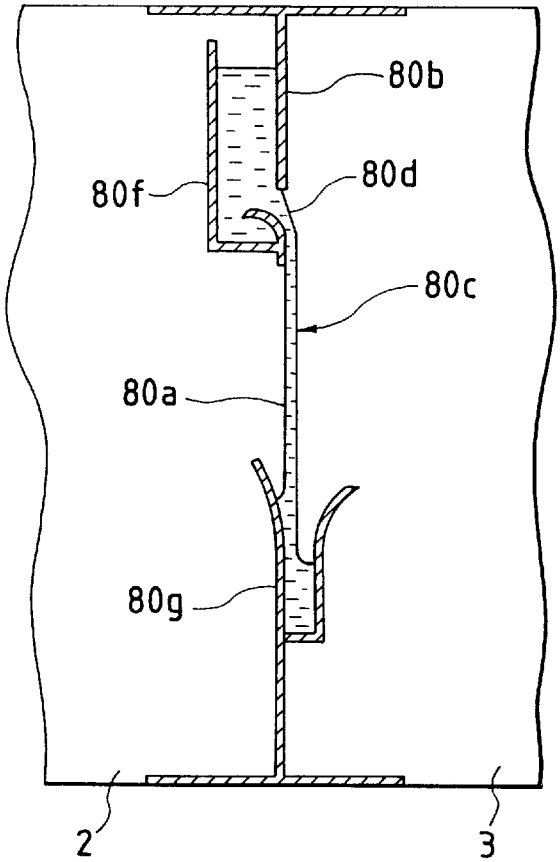

Each fluid partition wall device, as shown in FIG. 10B, comprises a partition wall 80*b* in the hermetically sealed chambers adjoining each other provided with an opening 80*c* sufficient to carry the wafer $W_1$ into and out of the hermetically sealed chamber, a slit 80*d* longer than the width of the opening 80*c* and disposed above the opening 80*c*, and water being dropped from the slit 80*d* thereby to form a water curtain 80*a* which is a fluid curtain.

Figure 11:
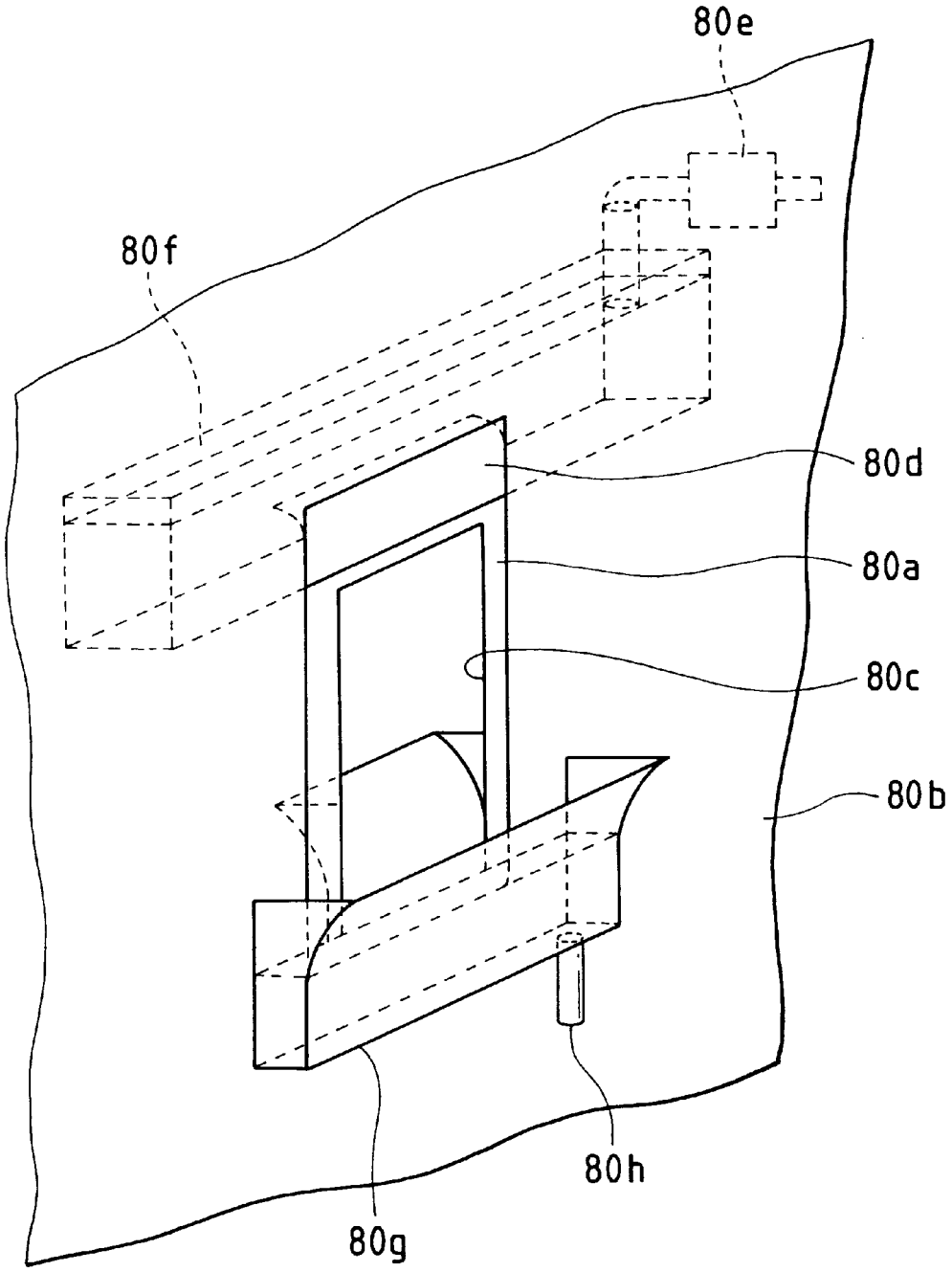
FIG. 11 is a perspective view showing the fluid partition wall device of FIGS. 10A and 10B.

The water supplied to the slit 80*d*, as shown in FIG. 11, is first stored in an upper reservoir tank 80*f* via a supply tube having a flow rate control device 80*e*. The slit 80*d* opens to the bottom of the upper reservoir tank 80*f* and can keep the water level in the upper reservoir tank 80*f* constant to thereby provide a stable quantity of water curtain 80*a* at all times.

The water falling from the slit 80*d* becomes a water curtain 80*a* wider than the width of the opening 80*c* in the partition wall 80*b* and covers the opening 80*c*, and shuts off the atmospheres in the two hermetically sealed chambers. The water collected in a lower reservoir tank 80*g* is discharged via a drain tube 80*h*.

When the wafer $W_1$ is to be transported between adjacent hermetically sealed chambers, for example, when the wafer $W_1$ to be carried from the wafer stocker unit 2 into the polishing unit 3, the wafer $W_1$ can simply be moved across the water curtain 80*a* without requiring the opening-closing operation like that of a slide type opening-closing door. The transportation of the wafer $W_1$ can be effected almost without spoiling the air-tightness of the two hermetically sealed chambers and moreover, complicated opening-closing operation or the like is not required at all, and therefore, the time spent for the transportation of the wafer $W_1$ can be shortened and the apparatus' driving portion of the opening-closing door or the like need not be complex.

Thereby, the automation, speedup and lower cost of the precision polishing apparatus can be greatly expedited.

The fact that the wafer becomes wet when it crosses the water curtain is not a problem, because the polishing step in the polishing unit and the washing step in the prewashing unit and the washing unit use slurry and liquid such as washing liquid or water. Rather, the so-called pre-wet effect, which makes the wafer fit the slurry or the like better in advance, and the washing of the wafer by the flow of the water curtain are advantages.

That is, since the drying step is provided finally, the fact that the wafer is wetted by the water curtain at the step preceding it does not pose any problem.

While in the present embodiment, the fluid partition wall device 80 by water curtain 80*a* is disposed between the hermetically sealed chambers leading from the wafer stocker unit 2 to the spin dehydration unit 6, it is of course possible to use the fluid partition wall device 80 instead of the opening-closing door 20 between the remaining hermetically sealed chambers as well if required.

Figure 12:
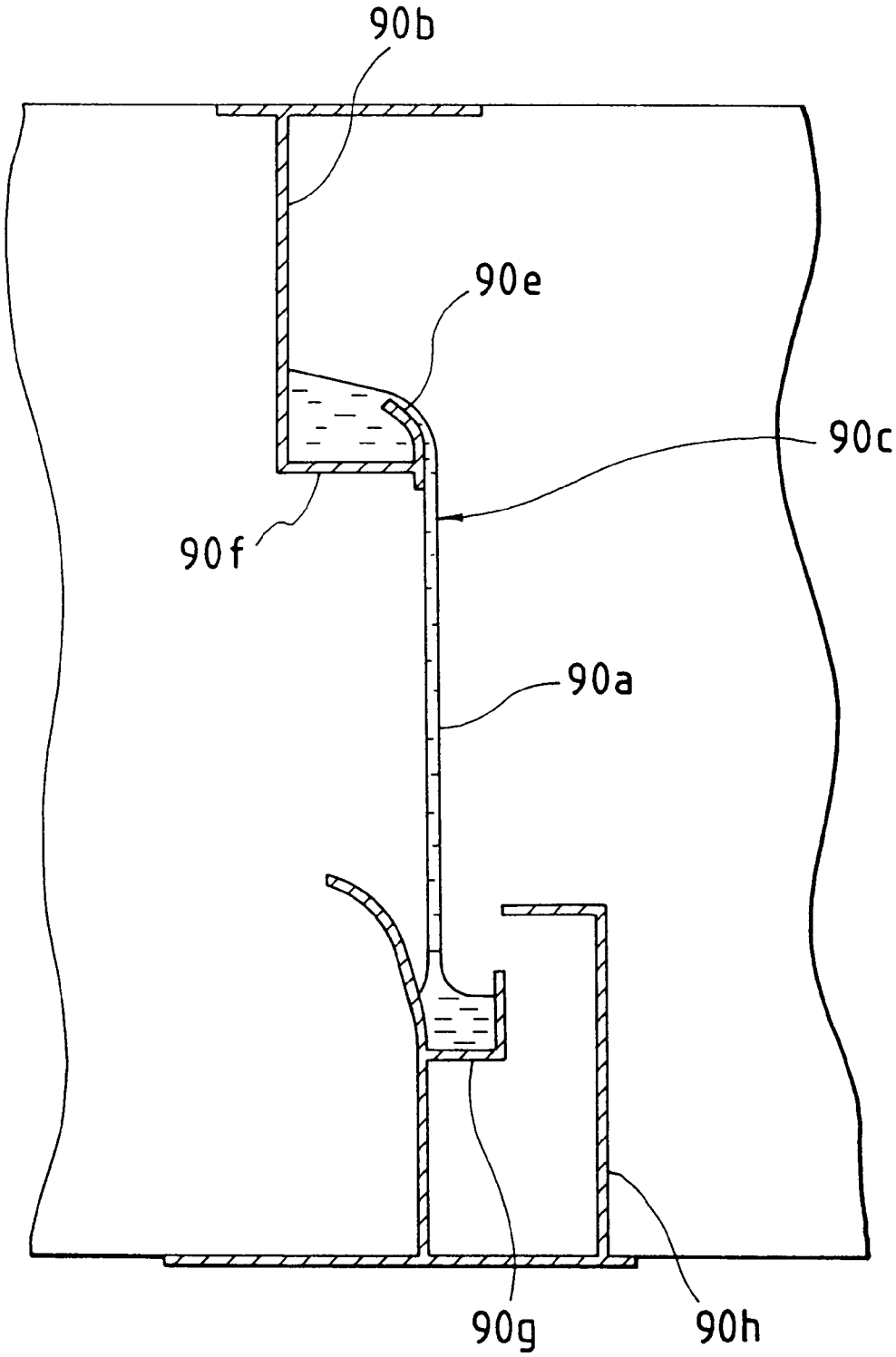
FIG. 12 is a fragmentary model cross-sectional view showing the fluid partition wall device according to the third embodiment of the present invention.

FIG. 12 shows a modification. This provides a liquid reservoir 90*f* having a weir 90*e* on the upper end of an opening 90*c* in a partition wall 90*b* similar to the partition wall 80*b* of FIG. 10B, and makes water overflow from the weir 90*e* to thereby form a water curtain 90*a*. Preferably a tank 90*h* may be disposed outside a lower reservoir tank 90*g* so that a great deal of water can be stored therein.

Figure 13:
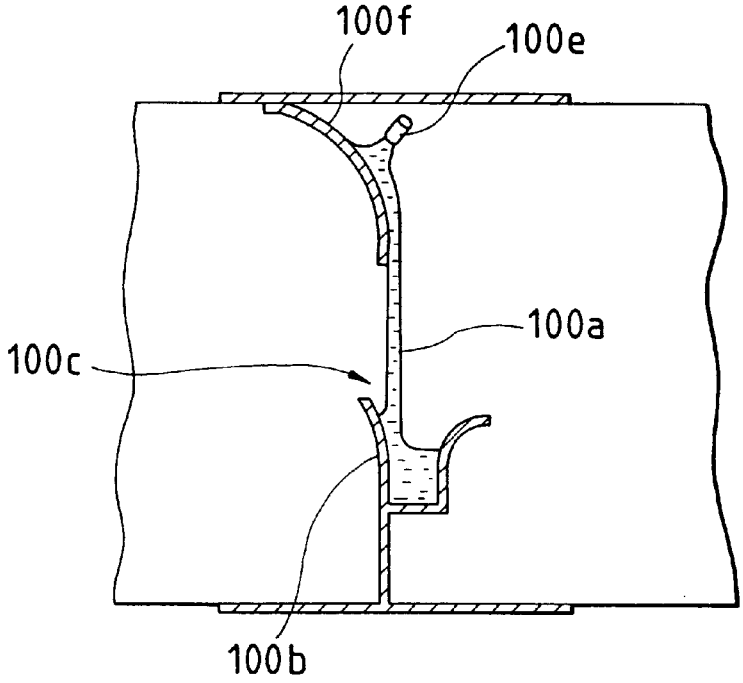
FIG. 13 is a fragmentary model cross-sectional view showing another fluid partition wall device according to the third embodiment of the present invention.

Alternatively, as shown in FIG. 13, the upper portion of an opening 100*c* in a partition wall 100*b* may be curved to form a guide wall 100*f*, and water discharged from a long nozzle 100*e* may be caused to flow directly along the guide wall 100*f* to thereby form a water curtain 100*a*.

Figure 14:
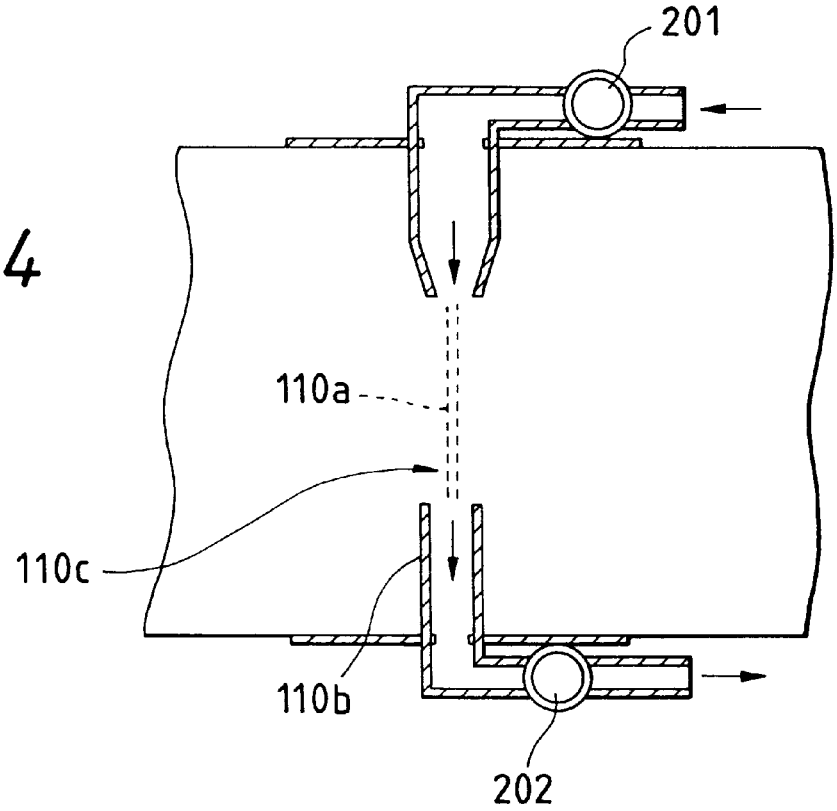
FIG. 14 is a fragmentary model cross-sectional view showing another fluid partition wall device according to the third embodiment of the present invention.

Further, as shown in FIG. 14, a conventional air curtain 110*a* may be provided in an opening 110*c* in a partition wall 110*b* between a flower fan 201 and a discharge fan 202. In this case, there is no possibility of the wafer becoming wet and therefore, there is added the advantage that a fluid partition wall device can be used instead of the opening-closing door or the like after the drying step.

Figure 15A:
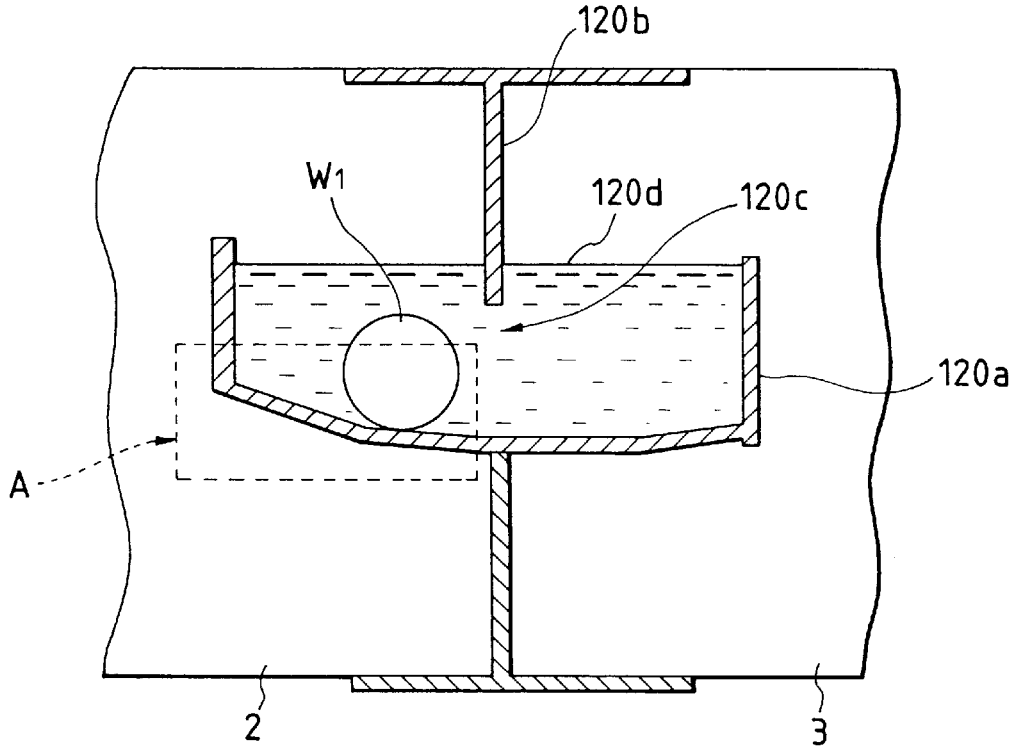
FIGS. 15A and 15B are model cross-sectional views showing another fluid partition wall device according to the third embodiment of the present invention in two different cross-sections.
Figure 15B:
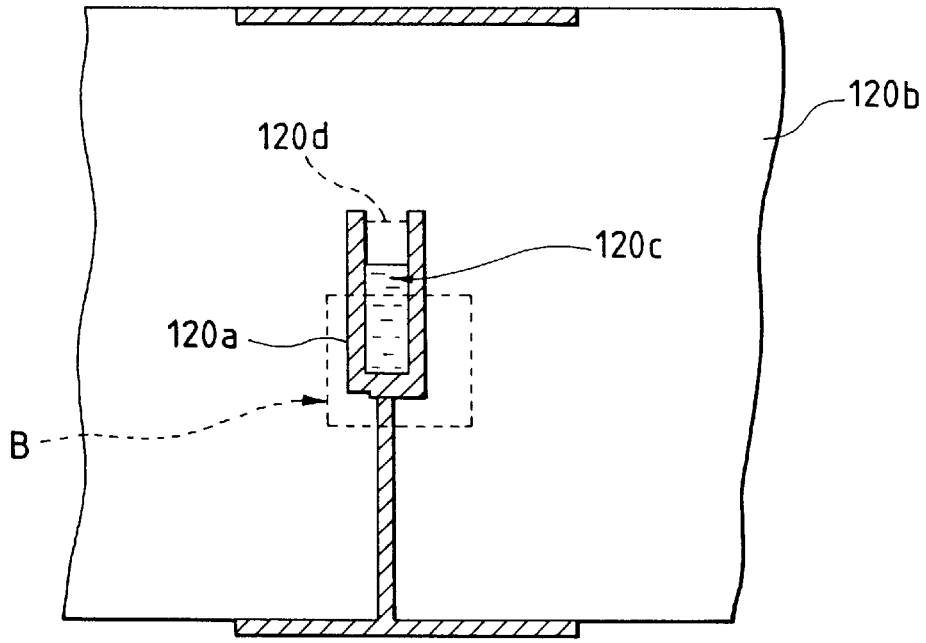

FIGS. 15A and 15B show still another modification. This is such that a liquid tank 120*a* is mounted in the partition wall 120*b* between two hermetically sealed chambers, for example, the wafer stocker unit 2 and the polishing unit 3, so that the wafer $W_1$ may be conveyed through the water in the liquid tank 120*a*. An opening 120*c* in the partition wall 120*b* opens below the liquid surface 120*d* in the liquid tank 120*a*, and the wafer $W_1$ thrown into the liquid tank 120*a* in the wafer stocker unit 2, as shown in FIGS. 16A and 16B, is conveyed to the polishing unit side by a water flow discharged from nozzles 120*e* which are water flow generating means provided in the side wall and bottom wall of the liquid tank 120*a*.

Figure 16A:
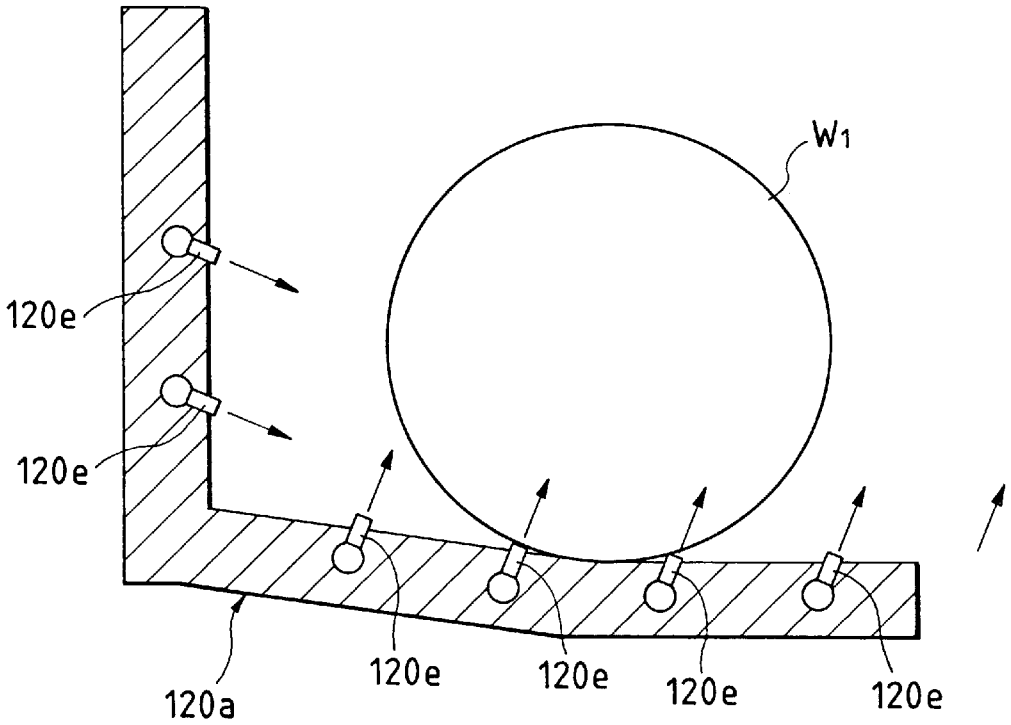
FIGS. 16A and 16B are enlarged cross-sectional views showing a portion A encircled by the broken line of FIG. 15A and a portion B encircled by the broken line of FIG. 15B on an enlarged scale.
Figure 16B:
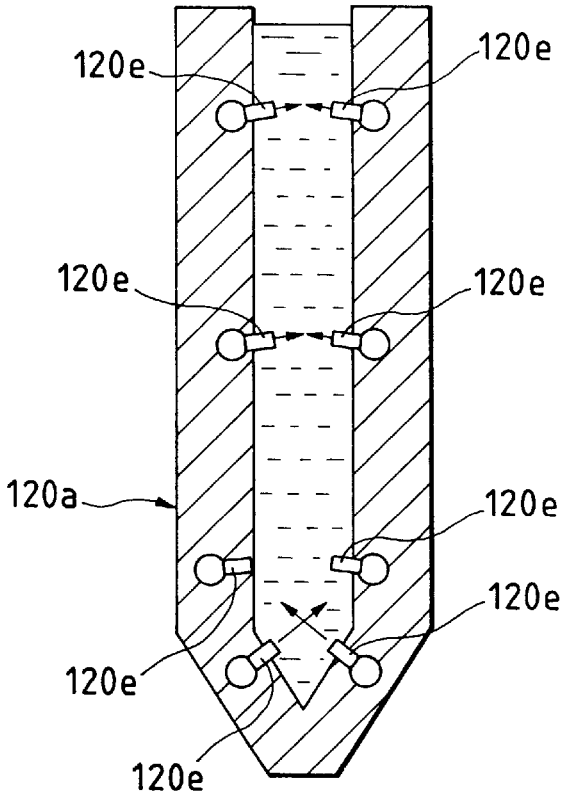
Figure 17:
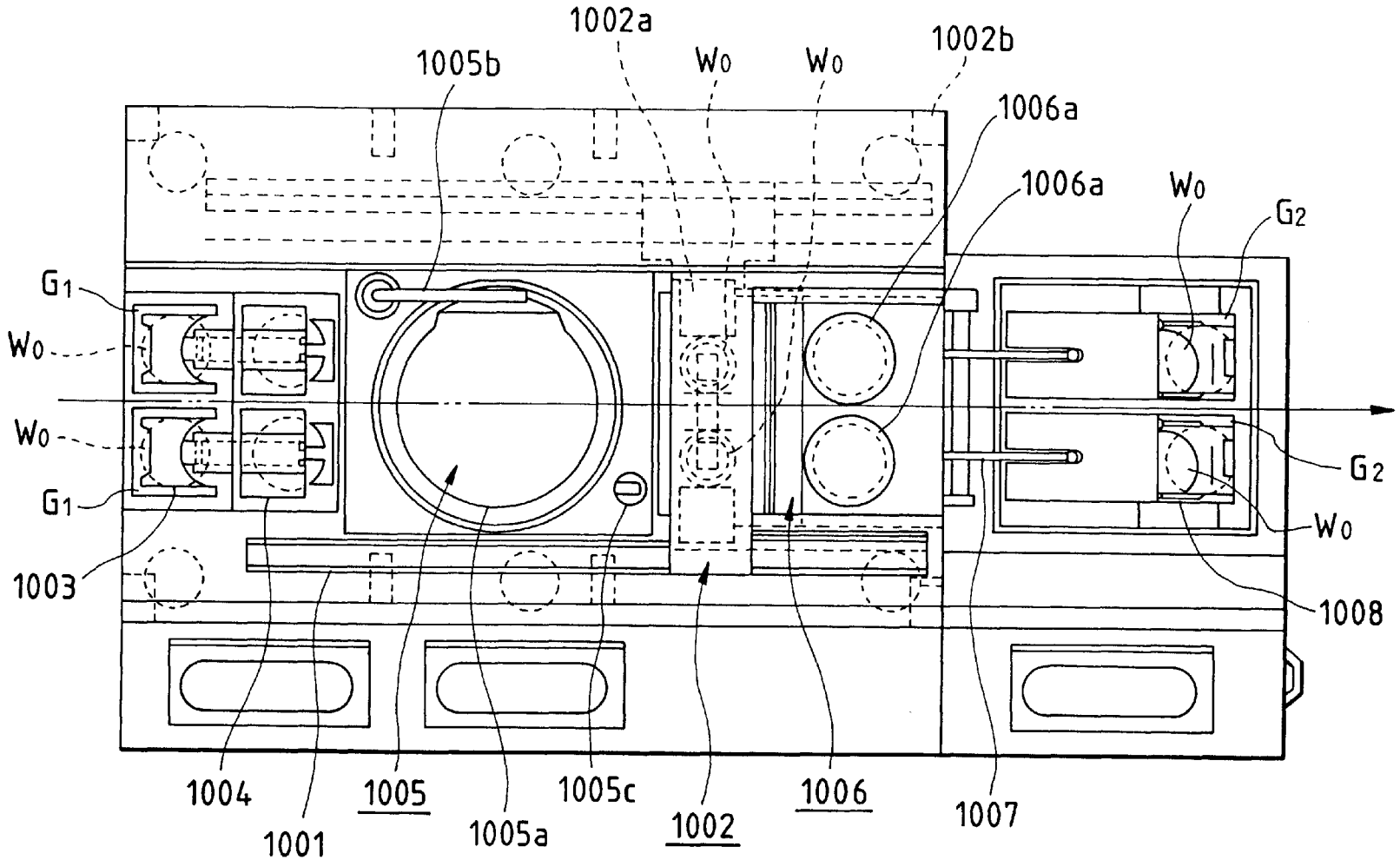
FIG. 17 is a plan view showing a precision polishing apparatus designed by the inventor prior to the present invention.

The nozzles 120*e* of the liquid tank 120*a* are disposed inclinedly toward the polishing unit side as shown in FIG. 16A, and discharge water flows toward the both surfaces of the wafer $W_1$ as shown in FIG. 16B. Also, in the present embodiment, the wafer is conveyed through the interior of the liquid tank 120*a* and therefore, the liquid is not scattered. Thus, it becomes possible to add a solute capable of removing any unnecessary matter produced in the preceding hermetically sealed chamber to the liquid and as a result the contamination by the unnecessary matter resulting from the conveyance of the wafer can be prevented more effectively. The solute preferable at this time is base such as potassium hydroxide or ammonia which expedites electrostatic repulsion to $SiO_2$ particles, polishing scraps, highly hydrophobic substances, etc., and removes these from the wafer, or alcohol such as isopropyl alcohol. Also, acid such as hydrochloric acid, sulfuric acid or hydrofluoric acid, which oxidized metals, organic matters, etc., neutral, cationic or anionic interfacial active agents or the like which can stably trap $SiO_2$ particles, polishing scraps, highly hydrophobic substances or the like in water are preferable solutes which can be suitably selected in conformity with the substance to be removed.

Further, an ultrasonic oscillation device (not shown) may be installed in the liquid tank 120*a* to remove any unnecessary matter from the wafer more effectively.

The present embodiment has the advantage that when the wafer moves between two hermetically sealed chambers, it has no possibility of spoiling the air-tightness of each hermetically sealed chamber. Therefore, in the present embodiment, the portion between the loading unit 1 and the first transporting robot chamber 11 and the portion between adjacent ones of the hermetically sealed chambers from the spin dehydration unit 6 to the unloading unit 8 are partitioned by the aforedescribed slide type opening-closing doors 20 and likewise, opening-closing doors 20 are also provided in the wafer carry-in port of the loading unit 1 and the wafer carry-out port of the unloading unit 8, but if necessary, these may be replaced by the fluid partition wall devices described in the present embodiment.

What is claimed is:

1. A precision polishing method comprising the steps of:

polishing an object to be polished by a polisher, provided in a first hermetically sealed chamber;

transferring the object having been polished from the first hermetically sealed chamber to a second hermetically sealed chamber through a partition device, wherein the partition device is a fluid partition device capable of moving the object to be polished while immersing the object in a fluid housed in the partition device; and controlling a pressure inside the first hermetically sealed chamber such that the pressure inside the first hermetically sealed chamber is lower than a pressure inside the second hermetically sealed chamber.

2. The precision polishing method according to claim 1, wherein the object to be polished comprises a semiconductor.

3. The precision polishing method according to claim 1, wherein the object to be polished has a surface to be polished having at least one of an insulating film and a metallic film formed thereon.

4. The precision polishing method according to claim 1, wherein the object to be polished is an insulative substrate having a semiconductor film formed thereon.

* * * * *

UNITED STATES PATENT AND TRADEMARK OFFICE

CERTIFICATE OF CORRECTION

PATENT NO. : 6,149,500
DATED : November 21, 2000
INVENTOR(S) : Kazuo Takahashi et al.

It is certified that error appears in the above-identified patent and that said Letters Patent is hereby corrected as shown below:

Title page,
Item [56] References Cited, under FOREIGN PATENT DOCUMENTS: "6252110" should read -- 6-252110 --.

Column 1,
Line 64, "1002*a*suspended" should read -- 1002*a* suspended --.

Column 2,
Line 7, "which" should read -- while --;
Line 26, "is" should read -- if --; and
Line 44, "provide a precision polishing apparatus" should be deleted.

Column 4,
Line 6, "controls" should read -- which controls --; and
Line 36, "to" should be deleted.

Column 6,
Line 18, "to and" should read -- and to --;
Line 26, "step, the" should read -- step. The --; and
Line 61, "an d" should read -- and --.

Column 7,
Line 2, "success ion" should read -- succession --; and
Line 15, "to" should be deleted.

Column 9,
Line 38, "stagger" should read -- staggered --.

UNITED STATES PATENT AND TRADEMARK OFFICE

CERTIFICATE OF CORRECTION

PATENT NO. : 6,149,500
DATED : November 21, 2000
INVENTOR(S) : Kazuo Takahashi et al.

It is certified that error appears in the above-identified patent and that said Letters Patent is hereby corrected as shown below:

Column 10,
Line 25, "to" should read -- is to --.

Signed and Sealed this

Nineteenth Day of February, 2002

*Attest:*

*Attesting Officer*

JAMES E. ROGAN
*Director of the United States Patent and Trademark Office*